US006508232B2

(12) United States Patent
Sogawa

(10) Patent No.: US 6,508,232 B2
(45) **Date of Patent: *Jan. 21, 2003**

(54) FUEL INJECTION SYSTEM FOR ENGINE

(75) Inventor: Masafumi Sogawa, Hamamatsu (JP)

(73) Assignee: Sanshin Kogyo Kabushiki Kaisha, Hamamatsu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/511,524

(22) Filed: Feb. 23, 2000

(65) Prior Publication Data

US 2002/0162541 A1 Nov. 7, 2002

(30) Foreign Application Priority Data

Feb. 23, 1999 (JP) ..... 11-044792

(51) Int. Cl.[7] ..... F02M 51/00
(52) U.S. Cl. ..... 123/478; 123/198 R
(58) Field of Search ..... 123/472, 478, 123/198 R

(56) References Cited

U.S. PATENT DOCUMENTS

| | | | | |
|---|---|---|---|---|
| 4,889,097 A | * | 12/1989 | Bevill et al. | 123/478 |
| 5,615,645 A | | 4/1997 | Kanno | 123/73 C |
| 5,632,250 A | * | 5/1997 | Kato et al. | 123/490 |
| 5,673,671 A | | 10/1997 | Kato | 123/470 |
| 5,699,766 A | | 12/1997 | Saito | 123/257 |
| 5,806,496 A | | 9/1998 | Saito | 123/478 |
| 5,884,604 A | | 3/1999 | Kato | 123/336 |
| 6,213,829 B1 | | 4/2001 | Takahashi et al. | 440/113 |

OTHER PUBLICATIONS

User's Guide for OMC Diagnostic Software by Outboard Marine Corporation, copyright 1997, pp. 11–12.

* cited by examiner

*Primary Examiner*—Andrew M. Dolinar
(74) *Attorney, Agent, or Firm*—Knobbe, Martens, Olson & Bear, LLP

(57) ABSTRACT

A fuel injection system for an engine includes an improved construction and provides a method for releasing a needle valve which has adhered to a valve seat in a fuel injector. The fuel injector is a normally closed type and the valve is activated by a solenoid to part from the valve seat to inject fuel. A first power supply unit is provided to supply electric power to the solenoid under an ordinary operating condition of the engine. A second power supply unit is additionally provided to supply electric power greater than the power supplied by the first power supply unit. In one embodiment, the second power supply unit includes a booster to raise the voltage. A switchover mechanism, such as detachable couplers, are provided to switch over between the first power supply unit and the second power supply unit. In one embodiment of the method, the operator detaches the coupler of the first power supply unit from the coupler of the solenoid and joins the coupler of the solenoid to the coupler of the second power supply. Then the operator operates the second power supply unit to supply the greater power to the solenoid to break the adhesion.

27 Claims, 8 Drawing Sheets

FUEL INJECTION SYSTEM FOR ENGINE

PRIORITY INFORMATION

The present application is based upon and claims priority to Japanese Application No. Hei 11-044792, filed Feb. 23, 1999, the entire contents of which is hereby incorporated by reference.

BACKGROUND OF THE INVENTION

1. Field of the Invention

This invention relates to a fuel injection system for an engine, and more particularly to a fuel injection system suitable for an outboard motor engine.

2. Description of Related Art

In the interest of improving engine performance and particularly fuel efficiency and exhaust emission control, many types of engines now employ a fuel injection system for supplying fuel to the engine. Generally, in this system, fuel is injected into an air induction device or directly into a combustion chamber by a fuel injector. This fuel injection has the advantages of permitting the amount of fuel delivered for each cycle of the engine to be adjusted. In addition, by utilizing the fuel injection system, it is possible to maintain the desired fuel air ratio under a wide variety of engine running condition.

An amount of the fuel injected by the fuel injector is usually controlled by an ECU (Engine Control Unit) in response to the engine running conditions. More specifically, the fuel is delivered to the fuel injector by a fuel pump under a certain fixed pressure and duration for injection per unit time, i.e., a duty ratio, is controlled by the ECU so that any required amount of fuel can be metered.

The fuel injector generally has a construction shown in FIG. 1. This figure illustrates a cross-sectional view showing an exemplary fuel injector.

The fuel injector, designated generally by the reference numeral 30, includes an injector body 32. An opening 34 is pierced longitudinally through the body 32. A magnet core 36 is fixedly positioned at one side of the opening 34, while a plunger 38 is slidably supported within the opening 34 at the other side of the opening 34. The plunger 38 is biased by a coil spring 40 toward an end of the opening 34 and has a valve 42 that is seated on a valve seat 44 when urged by the spring 40. The plunger 38 and the valve 42 are unified to define a needle valve. The valve 42, therefore, closes the opening 34 when seated on the valve seat 44. The end of the opening 34 at the side where the valve 42 is disposed is narrowed to define an injection nozzle 46. A solenoid or electromagnetic actuator 48 is formed in the injector body 32 and surrounds respective portions of the magnet core 36 and plunger 38. Fuel is supplied into the opening 34 through an inlet portion 50 by a fuel pump and hence fills the opening 34 under a certain fixed pressure. A fuel filter 51 is provided at the inlet portion 50.

When the solenoid 48 is activated by the ECU, the magnetic core 36 and plunger 38 are magnetized. The plunger 38 then slides toward the magnetic core 36 against the biasing force of the coil spring 40. The valve 42 is parted from the valve seat 44 accordingly. Because the fuel fills the opening 34 under the certain pressure, it is sprayed from the nozzle 46 when the valve 42 is unseated. The ECU then ceases the activation of the solenoid 48 after a calculated duration. Hence, the valve 42 returns to the initial position where it is seated on the valve seat 44 and closes the opening 34, i.e., the injection nozzle 46, again.

As is apparent from the descriptions provided above, the fuel injector 30 is a normally closed type. Although this type is easy to be controlled relative to a normally open type injector, it gives rise to a problem if the engine is not operated for a certain period of time, particularly, under a high temperature condition.

The problem is that the fuel residual in the opening 34 will congeal if the fuel injector 30 does not spray the fuel for a relatively long period of time. That is, if the fuel is gasoline, it will evaporate and escape through a clearance between the valve 42 and the valve seat 44. However, impurities or heavy oil components that are intermixed in the gasoline will remain in the opening 34 and deposit on the valve 42 and valve seat 44. The deposit of the heavy oil components acts as a kind of adhesive and the valve 42 occasionally adheres to the valve seat 44. High temperature may expedite this situation. The longer the time in which the injector 30 remains idle, the stronger the degree of adhesion will be. Also, the higher the fuel pressure is, the harder the bond will be.

If the adhesion occurs, the fuel injector may not work and the engine consequentially cannot function properly. Occasionally, by pushing the valve 42 from the nozzle 46, the problem of this adhesion may be resolved. However, this manner of repair may damage the valve 42 and invite a need to dissemble and repair the fuel injector 30.

After the engine has started, the solenoid 48 is powered by a generator. However, at the moment of the engine starting, the generator is not driven by the engine and only a battery can supply power to the solenoid 48. The battery under this condition, however, must supply power also to other electrical equipment such as, for example, a starter motor and fuel pumps. As a consequence, the power to the solenoid 48 is reduced and the separation or release of the valve 42 from the valve seat 44 is more difficult when starting the engine.

Another type of fuel injector exists that has no magnet core. In this type, the plunger 38 is simply drawn by the solenoid when it is magnetized. However, the aforementioned problem also can occur in this type of fuel injector.

This problem is exacerbated when used on an outboard motor, as compared to other land vehicles. The engine for a land vehicle (e.g., an automobile) can easily be designed such that the injection nozzle 46 of the fuel injector 30 are directed downward. In this arrangement, the fuel residual may leak out through the valve clearance with its own weight. However, if the engine is applied to an outboard motor, it is somewhat difficult for the fuel residual to pass through the clearance because the fuel injector 30 is laid generally horizontally and the clearance is usually only about 50 to 100 $\mu$m. Hence, the weight of the fuel residual does not help it pass through the clearance. Also, a drive unit of the outboard motor is arranged to be tilted up and down. When the drive unit is tilted up, in certain arrangement of the fuel injector 30, the injection nozzle 46 is directed upwardly. This arrangement aggravates the situation described above.

SUMMARY OF THE INVENTION

An aspect of the present invention thus involves the recognition that a need therefore exists for an improved fuel injection system that can easily release a valve from a valve seat in a fuel injector to ensure that the engine starts properly after a long period of non-use (i.e., inactivity).

In accordance with one aspect of the present invention, a fuel injection system is provided for an internal combustion engine. The engine has a cylinder body defining a cylinder bore in which a piston reciprocates. A cylinder head is affixed to an end of the cylinder body and defines a combustion chamber with the cylinder head and the piston. The fuel injection system comprises at least one fuel injector spraying fuel through at least one opening for supplying the fuel to the combustion chamber. The fuel injector includes a valve that is movable between a closed position and an open position to regulate fuel flow through the opening. An actuator mechanism includes at least one actuator that is coupled to valve to move the valve from the closed position. A first power supply is provided to supply power to the actuator under an normal operating condition of the engine. A second power supply is provided to supply greater power to the actuator than the power supplied by the first power supply. A switchover device is provided to selectively change the supply of power to the actuator between the first power supply and the second power supply.

In accordance with another aspect of the present invention, a fuel injection system is provided for an internal combustion engine. The engine has a cylinder body defining a cylinder bore in which a piston reciprocates. A cylinder head is affixed to an end of the cylinder body and defines a combustion chamber with the cylinder head and the piston. The fuel injection system comprises at least one fuel injector for spraying fuel to the combustion chamber. The fuel injector includes a valve and a valve seat on which the valve site. The fuel is sprayed only when the valve is unseated. A biasing mechanism biases the valve toward the valve seat so that the valve is normally seated on the valve seat. An actuator is provided to unseat the valve with an actuating force that acts against the biasing force of the biasing mechanism. The actuator is also adapted to unseat the valve with a separating force that is greater than the actuating force to separate the valve from the valve seat when the valve adheres to the valve seat.

In accordance with a further aspect of the present invention, an internal combustion engine comprises a cylinder body defining a cylinder bore in which a piston reciprocates. A cylinder head is affixed to an end of the cylinder body and defines a combustion chamber with the cylinder head and the piston. At least one fuel injector that sprays fuel through its opening is provided for supplying the fuel to the combustion chamber. The fuel injector includes a valve and a valve seat on which the valve site. The fuel is sprayed only when the valve is unseated. A biasing mechanism biases the valve toward the valve seat so that the valve is seated on the valve seat. Actuating means is provided for actuating the valve to be unseated with an actuating force that acts against the biasing force of the biasing means, and separating means is provided for separating the valve from the valve seat when the valve adheres to the valve seat with a separating force that is greater than the actuating force.

In accordance with a still further aspect of the present invention, a method is provided for controlling a fuel injection system. The fuel injection system has a fuel injector spraying fuel through at least one opening for supplying the fuel to a combustion chamber of an internal combustion engine. The fuel injector includes a valve closing the opening in its closing position under control of the control device. The method comprises actuating the valve with an ordinary force under normal operating conditions and actuating the valve with a separating force that is greater than the ordinary force when the valve remains in the closing position when the ordinary force is applied.

Further aspects, features and advantages of this invention will become apparent from the detailed description of the preferred embodiments and variations thereof that follow.

DETAILED DESCRIPTION OF PREFERRED EMBODIMENTS OF THE INVENTION

Figure 2:
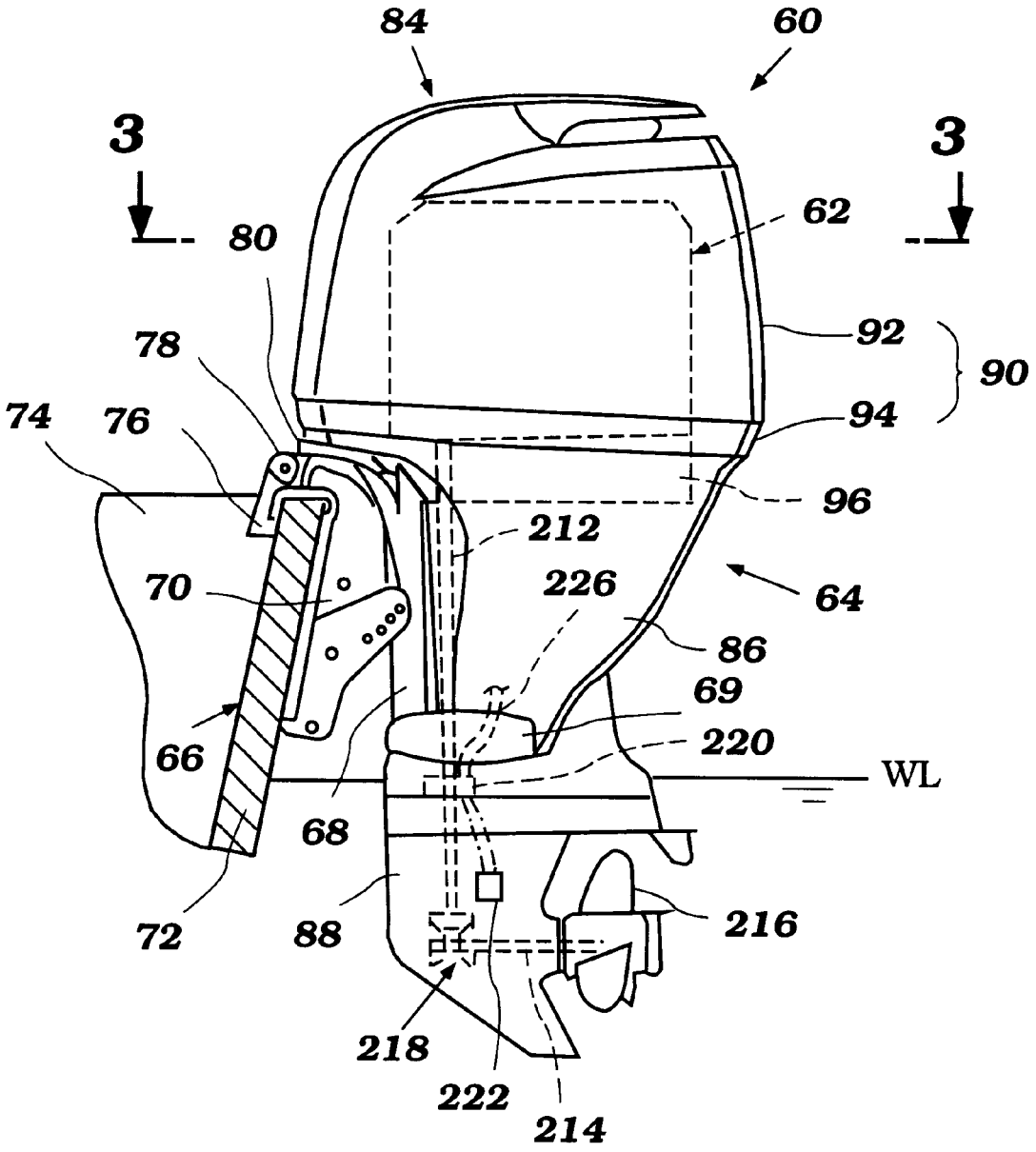
FIG. 2 is an elevational side view showing an outboard motor that employs a fuel injection system in accordance with a preferred embodiments of the present invention. An associated watercraft is also shown partially in section.
Figure 3:
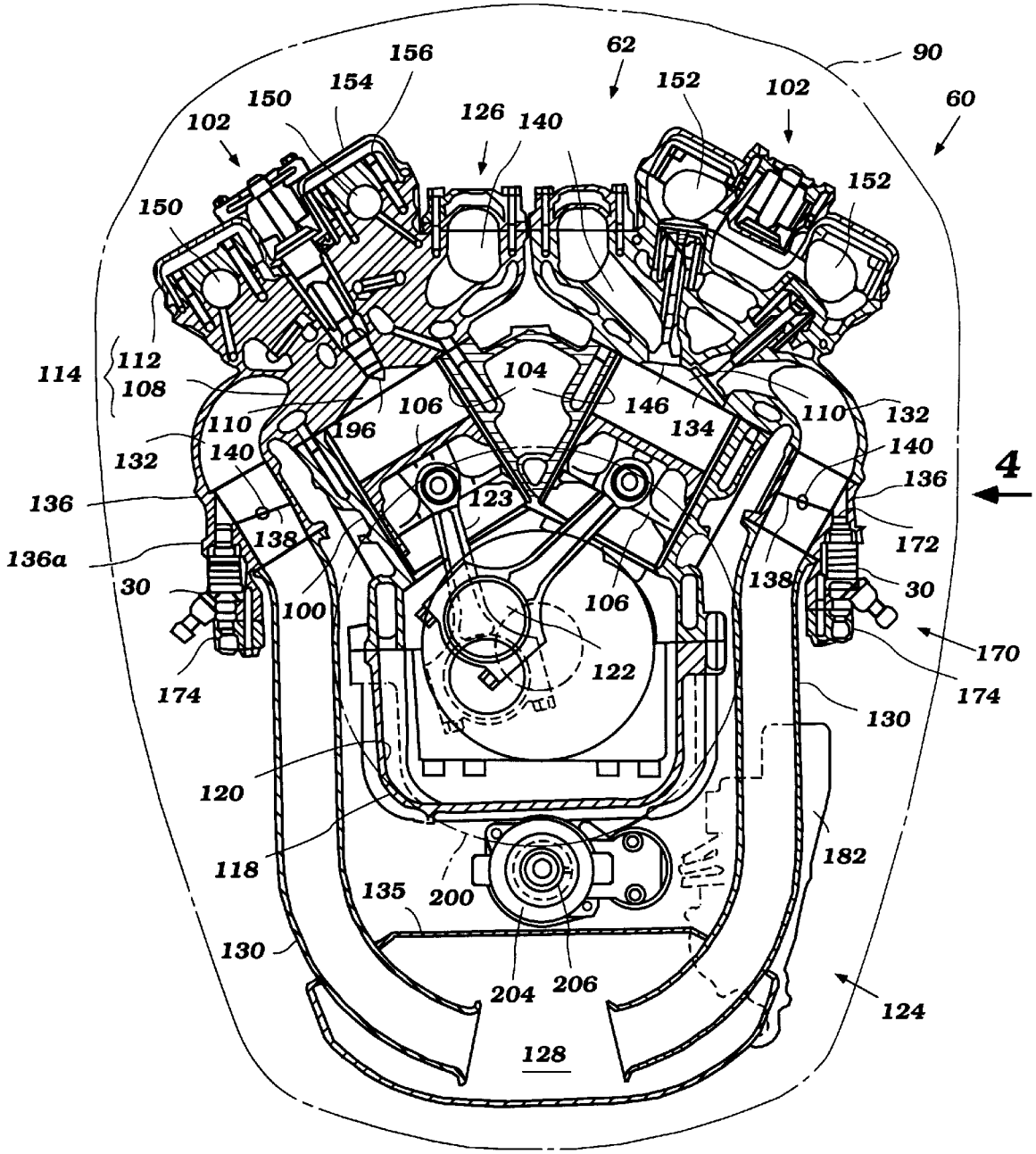
FIG. 3 is a cross-sectional top plan view taken along the line 3—3 in FIG. 2 to show an engine employed for the outboard motor that incorporates the fuel injection system. A protective cowling is shown in phantom.
Figure 4:
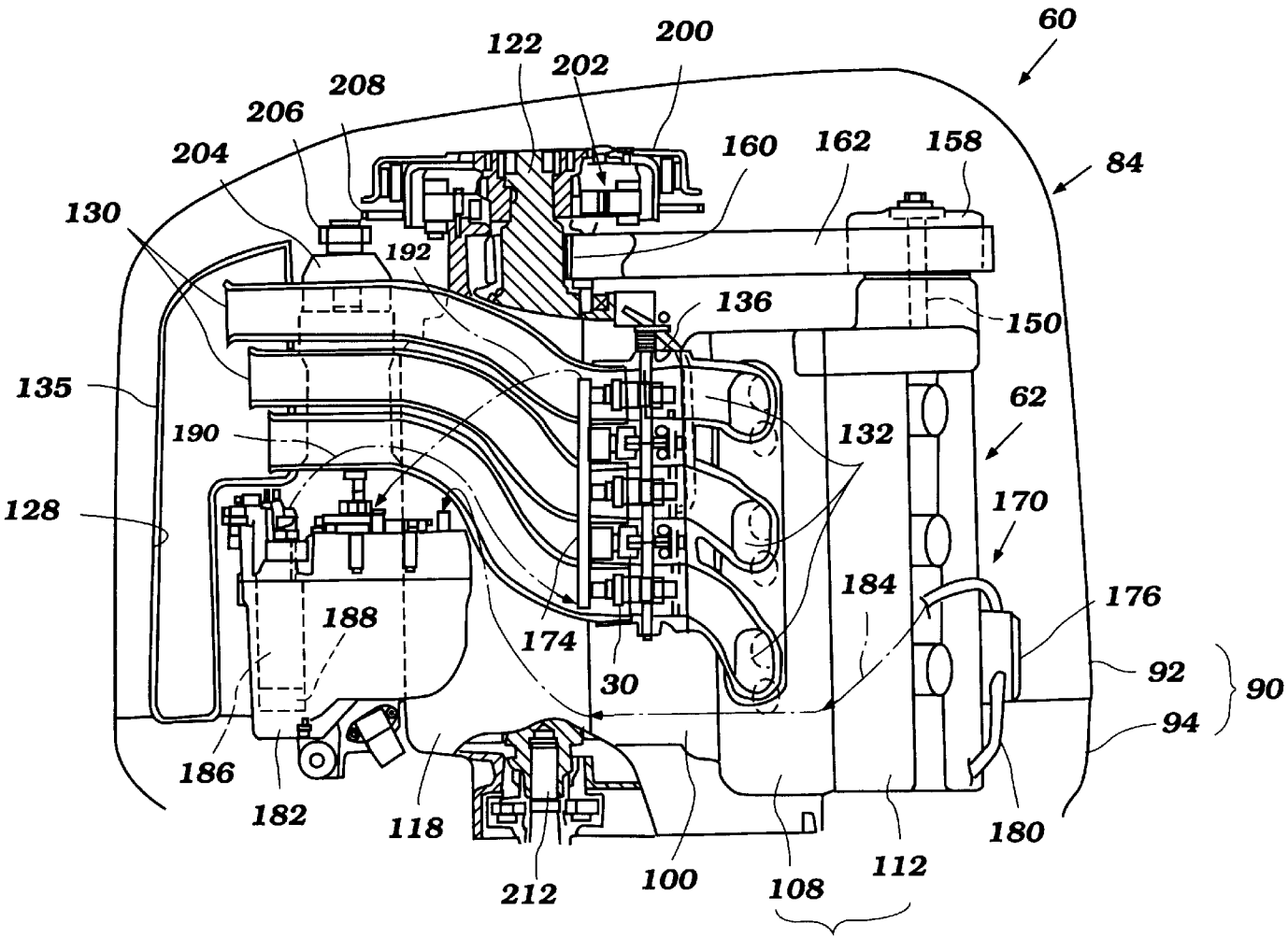
FIG. 4 is a side elevational and partially cross-sectional view of the engine of FIG. 3 as viewed from the position indicated by the arrow 4 in FIG. 3.

With reference to FIGS. 2 to 4, an outboard motor, designated generally by reference numeral 60, includes an internal combustion engine 62 arranged in accordance with an embodiment of the present invention. Although the present invention is shown in the context of an engine for an outboard motor, various aspects and features of the present invention also can be employed with engines for other types of marine outboard drive units (e.g., a stern drive unit) and also for, for example, land vehicles and stationary engines.

In the illustrated embodiment, the outboard motor 60 comprises a drive unit 64 and a bracket assembly 66. The bracket assembly 66 comprises a swivel bracket 68 and a clamping bracket 70. The swivel bracket 68 is affixed to the drive unit 64 by mount assemblies 69 and supports the drive unit 64 for pivotal movement about a generally vertically extending steering axis. The clamping bracket 70, in turn, is affixed to a transom 72 of the associated watercraft 74 by a transom screw 76 and supports the swivel bracket 68 for pivotal movement about a generally horizontally extending tilt axis, i.e., the axis of a pivot shaft 78. The swivel bracket 68 is steerable with a steering member 80.

As used through this description, the terms "fore," "forward" and "front" mean at or to the side where the clamping bracket 70 is located, and the terms "rear," "reverse" and "rearwardly" mean at or to the opposite side of the front side, unless indicated otherwise.

Although not shown, a hydraulic tilt system is provided between the swivel bracket 68 and clamping bracket 70 to tilt up and down and also for the trim adjustment of the drive unit 64. Since the construction of the bracket assembly 66 is well known in the art, further description is not believed to be necessary to permit those skilled in the art to practice the invention.

The drive unit 64 includes a power head 84, a driveshaft housing 86 and a lower unit 88. The power head 84 is disposed atop of the drive unit 64 and includes the engine 62 and a protective cowling assembly 90. The protective cowling assembly 90 includes a top cowling 92 and a bottom cowling 94.

The protective cowling assembly 90 generally completely encloses the engine 62. The top cowling 92 is detachably affixed to the bottom cowling 94 so that the operator can access the engine 62 for maintenance or for other purposes. The bottom cowling 94 has an opening at its bottom portion through which an exhaust guide member 96 extends. The exhaust guide member 96 is affixed to atop of the driveshaft housing 86. The bottom cowling 94 and the exhaust guide member 96, thus, form a tray. The engine 62 is placed onto this tray and is affixed to the exhaust guide member 96 to be supported thereby. The exhaust guide member 96 also has an exhaust passage therein through which a burnt charge is discharged as described later.

The engine 62 is of the V6 type and operates on a four stroke cycle principle and powers a propulsion device; however, this type of engine is merely exemplary. The present fuel injection system can be used with an engine having other numbers of cylinders, having other cylinder arrangements and/or operating other combustion principles (e.g., two-stroke or rotary).

As seen in FIGS. 3 and 4, the engine 62 has a cylinder body 100 that is formed with a pair of cylinder banks 102. Each of these banks 102 defines three cylinder bores 104 that extend generally horizontally and are spaced generally vertically with respect to one another. A piston 106 reciprocates in each cylinder bore 104.

A cylinder head member 108 is affixed to one end of the cylinder body 100 and defines six combustion chambers 110 with the pistons 106 and the cylinder bores 104. A cylinder head cover member 112 is affixed to cover the cylinder head member 108. The cylinder head member 108 and cylinder, head cover member 112 together form a cylinder head assembly 114.

The other end of the cylinder body 100 is closed with a crankcase member 118 defining a crankcase chamber 120 therein with the cylinder bores 104. A crankshaft 122 extends generally vertically through the crankcase chamber 120. The crankshaft 122 is pivotally connected with the pistons 106 by connecting rods 123 and rotates with the reciprocal movement of the pistons 106. The crankcase member 120 is located at the most forward position, then the cylinder body 100 and the cylinder head assembly 114 extend rearwardly from the crankcase member 118, one after another.

The engine 62 includes an air induction system 124 and exhaust system 126. The air induction system 124 is arranged to supply air charges to the combustion chambers 104 and comprises a plenum chamber 128, six air intake passages 130 and intake ports 132. The intake ports 132 are formed in the cylinder head member 108 and their communications with the combustion chambers 110 are opened or closed by intake valves 134. When the intake valves 134 are in open positions, the air intake passages 130 communicate with the combustion chambers 110 through the intake ports 132.

The plenum chamber 128 is defined in a plenum chamber member 135 positioned in front of the crankcase member 118. The plenum chamber member 135 has an inlet opening, although it is not shown, at an appropriate location on the member 130. The plenum chamber 128 functions as an intake silencer and/or a coordinator of air charges. Respective upstream portions of the air intake passages 130 are inserted into the plenum chamber member 135. The air intake passages 130 then extend generally horizontally and rearwardly from the plenum chamber member 135 along both sides of the cylinder body 100. The respective intake passages 130 are spaced generally vertically with each other. The intake passages 130 are, at downstream portions, joined with the intake ports 132 by interposing throttle bodies 136.

The respective throttle bodies 136 support butterfly-type throttle valves 138 therein for pivotal movement about axes of valve shafts 140 extending generally vertically. The throttle valves 138 regulate an amount of an air charge that is delivered to the combustion chambers 110 through the air intake passages 130 under various engine running conditions including an engine start up condition. In order to adjust openings of the throttle valves 138, a throttle cable extends forwardly from the valve shafts 140 through the bottom cowling 94. The throttle cable is operable by the operator in an appropriate manner that is well known in the art.

Although omitted in the figures, the top cowling 58 has an air introducing construction at rear end thereof. The air introducing construction introduces air outside of the cowling assembly 90 into its interior. The air introduced into the interior of the cowling assembly 90 goes to the opening of the plenum chamber member 135 and then enters the plenum chamber 128. The air is finally supplied to the respective combustion chambers 110 through the air intake passages 130 as an air charge. As aforenoted, an amount of the air charge that required by each combustion is regulated with the opening of the throttle valves 138.

The exhaust system 126 is arranged to discharge burnt charges or exhaust gasses outside of the outboard motor 60 from the combustion chambers 110. For this purpose, exhaust ports 144 are formed in the cylinder head member 108 and their communication with the respective combustion chambers 110 are opened or closed by exhaust valves 146. When the exhaust ports 144 are opened, the combustion chambers 110 communicate with exhaust ducts which are primarily formed between the cylinder head assemblies 114 and lead the exhaust gasses downstream with the exhaust system 126. Each exhaust duct includes an exhaust manifold that collects the exhaust gasses and an exhaust passage that is formed within the exhaust guide 96.

Two camshafts 150 extend generally vertically in the cylinder head assemblies 114 of each bank 102 to activate the intake valves 134 and exhaust valves 146. The camshafts 150 have cam lobes 152 to push the intake and exhaust valves 134, 146 at certain timings to open or close the respective ports 132, 140. The camshafts 150 are journaled on the cylinder head member 108 and affixed thereto with a fixing member 154 and bolts 156. The camshafts 150 are driven by the crankshaft 88. For this purpose, the respective camshafts 150 have sprockets 158, while the crankshaft 122 also has a sprocket 160. A timing belt or chain 162 is wound around the sprockets 158, 160. With rotation of the crankshaft 122, therefore, the camshafts 150 rotate also.

The above described engine of course is exemplary of one type of engine on which the present fuel injection system and valve actuator mechanism can be employed. Other arrangements and layouts of the above described engine components are also possible, as will be apparent from the description below.

Figure 1:
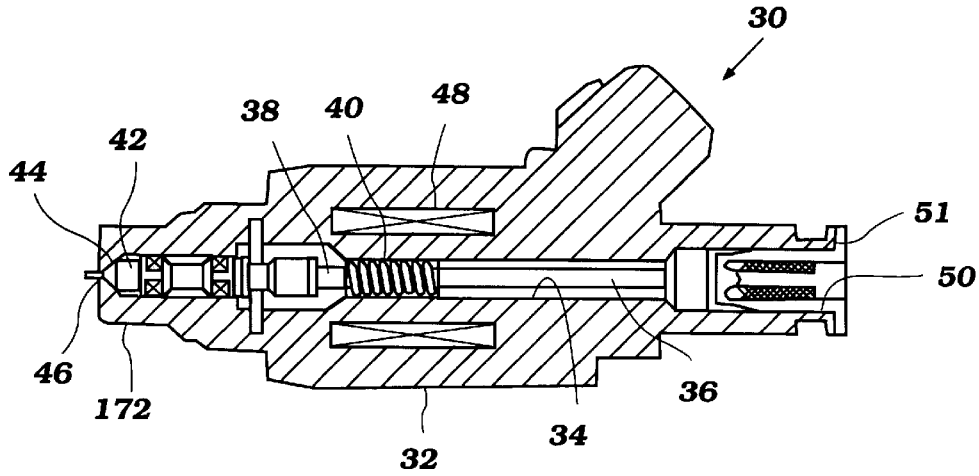
FIG. 1, as noted above, is a cross-sectional view of an exemplary fuel injector. This figure primarily is provided in order to assist the readers' understanding of the problems with a construction of the fuel injector. The figure, however, still illustrates a fuel injector that is applied to fuel injection systems in accordance with embodiments of the present invention.

The engine 62 has a fuel injection system 170 for supplying a fuel charge to the combustion chambers 110. In the illustrated embodiment, the fuel is gasoline. The fuel injection system 170 includes the fuel injectors 30, one of which is shown in FIG. 1 and described above. The construction of the fuel injector 30 therefore will not be repeated unless additional details are necessary. In the illustrated embodiment, six injectors 30 are provided and each cylinder bore 104 has each one of the injectors 30. Injector holders 136*a*, which support the respective injector bodies 32, are unified with the respective throttle bodies 136. Tips 172 of the injectors 30 that involves the injection nozzles 46 are directed to the intake ports 132 so that the sprayed fuel is directed toward the combustion chambers 110. Three injectors 30 on each bank 102 are linked together by a fuel rail 174 that are also held by the injector holders 136*a*. The fuel rail 174 has an internal fuel passage that defines a portion of a fuel supply and return conduit described below.

Because of the aforedescribed arrangement, the injection nozzles 46 of the injectors 30 are laid generally horizontally when the drive unit 64 is in a tilted down position. They, however, are directed upwardly when the drive unit 64 is tilted up as is apparent in FIG. 3.

The fuel injection system 170 includes a main fuel supply tank which is actually placed in the hull of the associated watercraft 74. Fuel is drawn from the fuel tank by a manually operated fuel pump (not shown) and a low pressure fuel pump 176 through a first fuel supply conduit 180. The low pressure fuel pump 176 is a diaphragm type operated by one of the camshafts 150. In the illustrated embodiment, it is, therefore, mounted on the cylinder head assembly 74.

A first supply conduit 180 extends from the associated watercraft 74 to the interior of the protective cowling assembly 90 through an opening formed at a front portion of the bottom cowling 94. A quick disconnect coupling, therefore, is provided in this first supply conduit 180 to connect and disconnect the both portions existing outside and inside of the cowling assembly 90. A fuel filter is positioned in the first fuel supply conduit 180 at an appropriate location also.

From the low pressure fuel pump 176, the fuel is supplied to a vapor separator 182, which is also included in the fuel supply system 170, through a second fuel supply conduit 184 and then temporarily stored therein. At the vapor separator end of the second supply conduit 184, there is provided a float valve that is operated by a float so as to maintain a uniform level of the fuel contained in the vapor separator 182.

The fuel injection system 170 also includes a high pressure fuel pump 186 driven by an electric motor 188 and placed in the vapor separator 182 with the motor 188. The high pressure fuel pump 186 pressurizes the fuel that is delivered to the fuel injectors 30 through a delivery conduit 190 and the aforenoted fuel rail 174. The fuel rail 174 is, therefore, a portion of the delivery conduit 240.

A fuel return conduit 192 is also provided between the fuel injector 30 and the vapor separator 182. The excess fuel that has not been injected by the injector 30 returns to the vapor separator 182 through this conduit 192. The fuel rail 174 defines a portion of the return conduit 192 also, because the excess fuel from the fuel injectors 30 placed at lower positions flows through the fuel rail 174. A pressure regulator is incorporated in the return conduit 192 to limit the pressure that is delivered to the fuel injectors 30.

An amount of each fuel injection and injection timing are controlled by an ECU that will be described shortly.

The engine 62 additionally has a firing system. Six spark plugs 196 are exposed into the respective combustion chambers 110 and fire an air fuel charge at a proper timing. This firing timing is also controlled by the ECU. The air fuel charge is formed with an air charge supplied through the main air intake passages 130 and a fuel charge sprayed by the fuel injectors 30. The burnt charge, as described above, is discharged outside through the exhaust system 126.

A flywheel assembly 200 is affixed atop of the crankshaft 122 so as to be driven thereby. The flywheel assembly 200 includes a generator 202 to supply electric power to the solenoids 48 of the fuel injectors 30, the firing system, the ECU and other electrical equipment directly or indirectly via a battery when the engine is operated. The battery is disposed in the hull of the associated watercraft or in the protective cowling assembly 90. Additionally, a starter motor 204 is disposed in proximity to the flywheel assembly 200. The starter motor 204 has a gear 206 provided atop thereof that can mesh with a ring gear 208 placed on the flywheel assembly 200 when the engine 62 starts. Because the crankshaft 122 is driven by the starter motor 204, not by the pistons 106 at this starting moment. After the engine 62 has started, the gear 206 on the starter motor 204 is rapidly disengaged with the ring gear 208 of the flywheel assembly 200. The starter motor 204 is activated with the electric power supplied by the battery.

With reference to FIG. 2, the driveshaft housing 86 depends from the power head 84 and supports a driveshaft 212 which is driven by the crankshaft 122 of the engine 62. The driveshaft 104 extends generally vertically through the exhaust guide 96 and then driveshaft housing 86. The driveshaft housing 86 also defines internal passages which form portions of the exhaust system 126.

Although not shown, a lubricant reservoir depends from the exhaust guide 96 within the driveshaft housing 86. A lubricant pump is driven by the driveshaft 212 to supply lubricant to engine portions that need lubrication. The lubricant, then, returns to the lubricant reservoir with its own weight.

The lower unit 88 depends from the driveshaft housing 86 and supports a propeller shaft 214 which is driven by the driveshaft 212. The propeller shaft 214 extends generally horizontally through the lower unit 88. In the illustrated embodiment, the propulsion device includes a propeller 216 that is affixed to an outer end of the propeller shaft 214 and is driven by the propeller shaft 214. A transmission 218 is provided between the driveshaft 212 and the propeller 216. The transmission 218 couples together the two shafts 212, 216 which lie generally normal to each other (i.e., at a 90° shaft angle) with a bevel gear combination.

The lower unit 88 also defines an internal passage that forms a discharge section of the exhaust system 126. At engine speed above idle, the majority of the exhaust gasses are discharged to the body of water surrounding the outboard motor 60 through the internal passage and finally through a hub of the propeller 212, as well known in the art.

The outboard motor 60 has an engine cooling system that includes a water pump 220 driven by the driveshaft 212. The water pump 220 introduces cooling water from the aforenoted body of water through a water inlet 222 which opens at the lower unit 88. The water inlet 222 is connected to the water pump 220 through a water inlet passage 224, while the water pump 220 is joined to a plurality of waterjackets in the engine 62 through a water supply passage 226.

As described above, the fuel residual in the opening 34 may congeal if the fuel injector 30 does not spray the fuel for a relatively long period of time and as a consequence the valve 42 tends to adhere to the valve seat 44. In this embodiment, a construction and method of operation of an actuator mechanism is provided to release the valve 42 from the valve seat 44.

Figure 6:
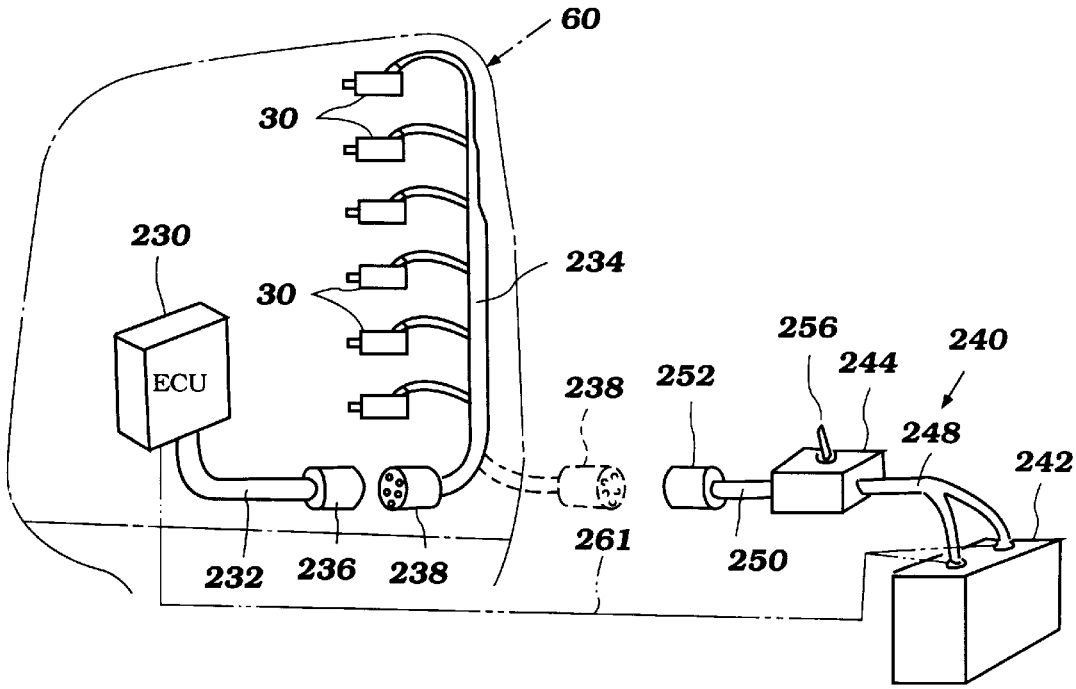
FIG. 6 is a schematic view showing a valve actuator mechanism of the fuel injection system with an operational mode to release the valve from the valve seat in the fuel injector.

FIG. 6 schematically illustrates the construction of a valve actuator mechanism and an associated method of operation. The ECU, which is now designated by reference numeral 230, is usually powered by the generator 202 and electrically controls the engine operations as noted above. The ECU 230 has a distribution cable 232. Meanwhile, the fuel injectors 30, and more specifically their solenoids 48 are connected to a wire harness 234. The distribution cable 232 and wire harness 234 are coupled together by couplers 236, 238 under the usual conditions of engine operations. The coupler 236 is attached to the end of the distribution cable 232, while the coupler 238 is attached to the wire harness 234.

In the illustrated embodiment, an emergency powering device 240 is provided. The emergency powering device 240 comprises a battery 240 and a booster (e.g., an amplifier) and timer unit 244. The battery 240 is a power source that has the voltage of 12 volts. The booster and timer unit 244 is connected to the battery 240 with a power cable 248. Another power cable 250 which has a coupler 252 is connected to the other side of the booster and timer unit 244.

The booster and timer unit 244 includes a fuse 254, a manual switch 256, a timer circuit 258 and a booster or voltage raising circuit 260 and these components are connected together in series. The fuse 254 is connected to the battery 242, while the booster 260 is connected to the coupler 252. In the illustrated embodiment, the booster 260 can increase 12 volts to 24 volts and the timer 258 can hold the power supply for a preset time, for example, ten seconds.

Under the usual conditions of engine operations, the couplers 236, 238 are coupled together and electric power is supplied to the fuel injectors 30, specifically, to the solenoids 48, through the ECU 230. The solenoids 48 actuate the valves 42 to open, i.e. to part from the valve seats 44, by an ordinary force that is produced by the electric power for a duration that is controlled by the ECU 230. The ordinary force generally corresponds to a predetermined force or falls within a predetermined range of forces required to actuate the valves when the engine is operating in normal ranges of loads and speeds.

In the event, however, the valves 42 cannot be parted from the valve seats 44 against the control of the ECU 230 due to the aforenoted adhesion, the operator uncouples the coupling 238 from the coupling 236 and then joins it to the coupling 252 of the emergency powering device 240. The operator, then, turns on the manual switch 256 so that the emergency powering device 240 can provide the power from the battery 242 to the harness 234. Since the booster 260 raises the voltage of 12 volts of the battery to 24 volts, twice as much as the ordinary power is supplied to the solenoids 48. Thus, the solenoids 48 actuate the valves 42 with a force that is greater than the ordinary force. This force is sufficient to separate the valves 42 from the valve seats 44 against the adhesion force. Accordingly, the fuel injectors 30 recover to their usual states and are again controllable by the ECU 230.

In the meantime, when the manual switch 256 is turned on, the timer 258 starts and automatically shuts off or ceases the power supply after the preset time such as ten seconds. The operator then changes over the manual switch 256 to the turn off position. Thus, the solenoids 48 are no longer supplied such a large power unless the operator again turns on the switch 256.

Figure 5:
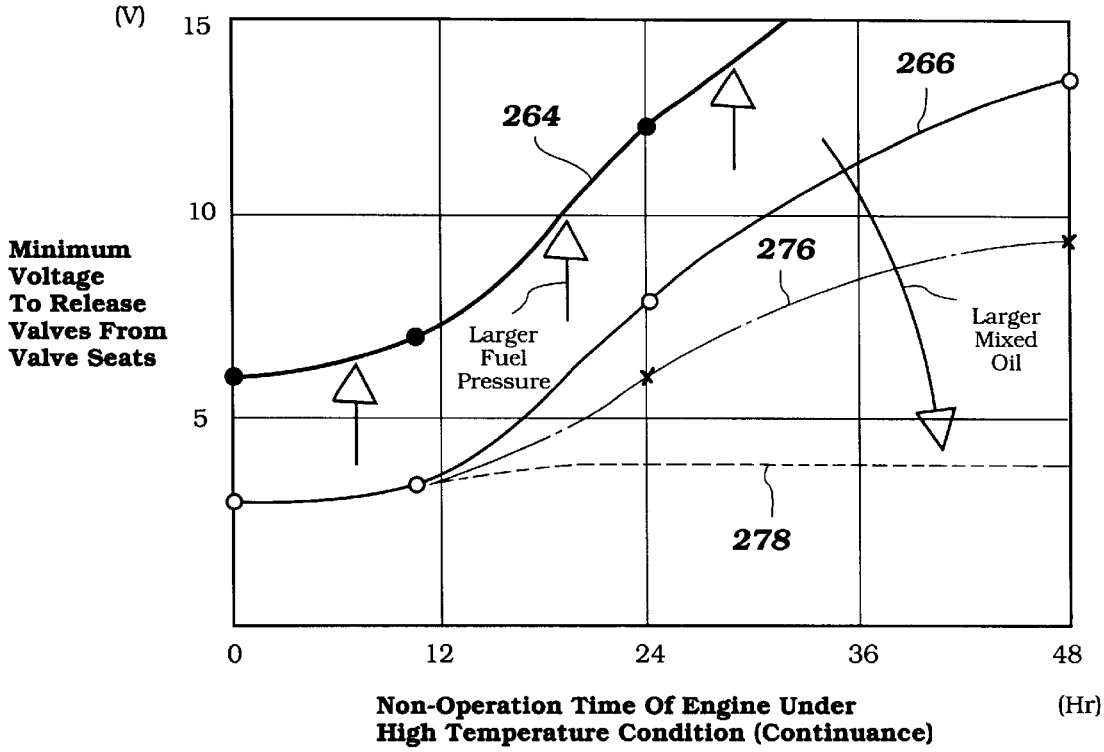
FIG. 5 is a graphical view showing the relationships between the time in which the fuel injector (and the engine) operates under a high temperature condition and the minimum voltage that is supplied to a solenoid of the fuel injector to release a valve from a valve seat. The graph also shows how the curves change under different fuel pressures and also under different amounts of oil that is mixed with the fuel.

FIG. 5 illustrates the minimum voltage supplied to the solenoids 48 for releasing the valves 42 from the valve seats 44 versus the dormant or inactive time of the engine 62 under a high temperature (for example, between 30° C. and 40° C.) condition.

As seen in FIG. 5, the longer the dormant time lasts, the higher the required minimum voltage to release the valves 42 from the valve seats 44. In addition, if the fuel pressure that is regulated by the pressure regulator is high, the required minimum voltage is also high. That is, the curve 264 is positioned higher than the curve 266 in the graph because the fuel pressure with this curve 264 is higher than that with the curve 266. However, the voltage of 24 volts is enough to release the valves 42 even though the time is rather long with the curve 264.

As described above, with the present valve actuator mechanism and associated mode of operation, the valves 42 can easily released from the valve seats 44 under the adhesion condition and hence the engine 62 can start quickly and properly even after a long time between engine starts.

Although another battery can be additionally provided for operating the starter motor 204, the battery 242 can be commonly used for supplying the power to the operation of the starter motor 204 and for the emergency operation as described above. In this variation, the ECU 230 is coupled with the battery 242 by a cable 261 as shown in phantom line in FIG. 6. The cable 261 is detached from the battery 242 when the battery 242 is used for the emergency operation and the power cable 248 is connected instead of the cable 261.

The timer 258 is not necessarily employed. If it is not provided, the operator can simply turn off the manual switch 256 after the necessary time has elapsed, i.e., after the engine has started and is running properly.

In addition, since the ECU 230 and the fuel injectors 30 are connected with the couplers 236, 238, assembling and dissembling them is easy, both in production and for maintenance or repair. However, the coupler connections is but one form of the switchover device that can be used to change the power supply to the valve actuator between two or more power supply units. For instance, the switchover device can use a multi-pole switch instead of the coupler connections. The switch can have a movable connector or contact connected to the fuel injectors and two fixed connectors or connects, each connected to the ECU and the emergency powering device. Instead of exchanging the connections of the couplers 236, 238, 252, the operator may operate the switch.

Further, it is also available that all cables and harnesses are connected without any couplings and the switchover operation from the ECU to the emergency powering device is achieved by the control of the ECU itself. That is, the ECU will check whether the starting operation is completed or not and, if it is negative, the ECU switches the power supply from a usual power source to a boosted power source. Then, after a preset time has elapsed, the ECU again switches to the usual power source from the boosted power source and/or again checks whether the starting operation is complete and all cylinders are functioning properly before switching over the power supply. The ECU in this mode thus contains the switchover device.

Figure 7:
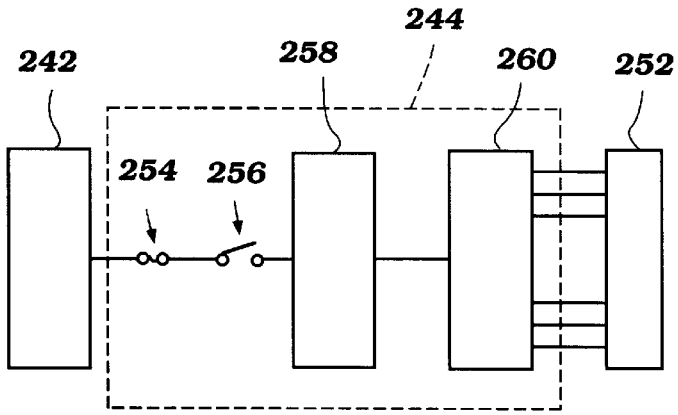
FIG. 7 is a schematic view showing an electric circuit of the device illustrated FIG. 6.

The valve actuator mechanism shown in FIGS. 6 and 7 are most suitable for an outboard motor that has the engine arrangement shown in FIGS. 2 to 4. However, other types of outboard motors and/or engines also can employ this construction and method.

Figure 8:
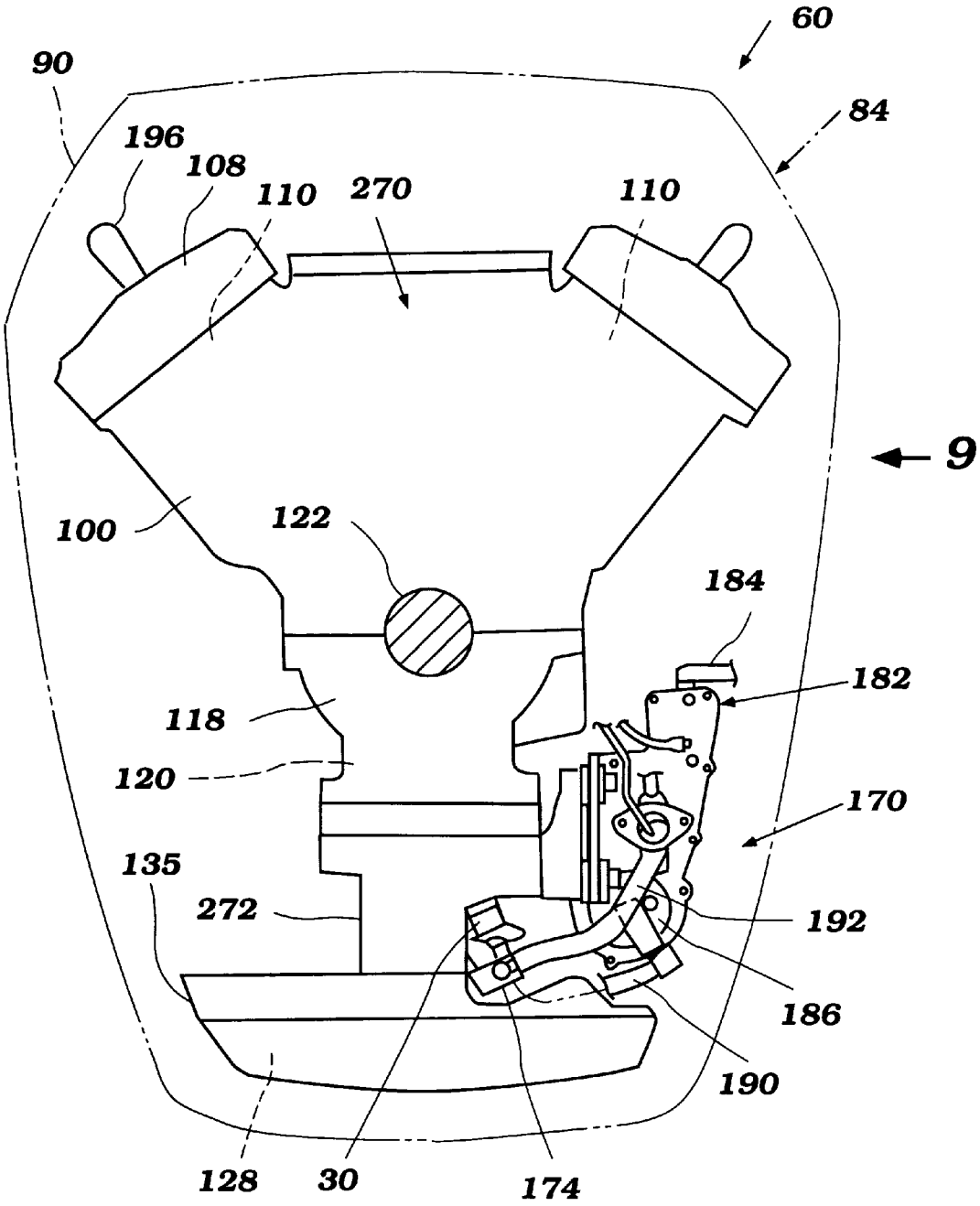
FIG. 8 is a top plan view showing another engine which can employ the valve actuator mechanism in the aforenoted embodiment of the present invention. A protective cowling is shown in phantom.
Figure 9:
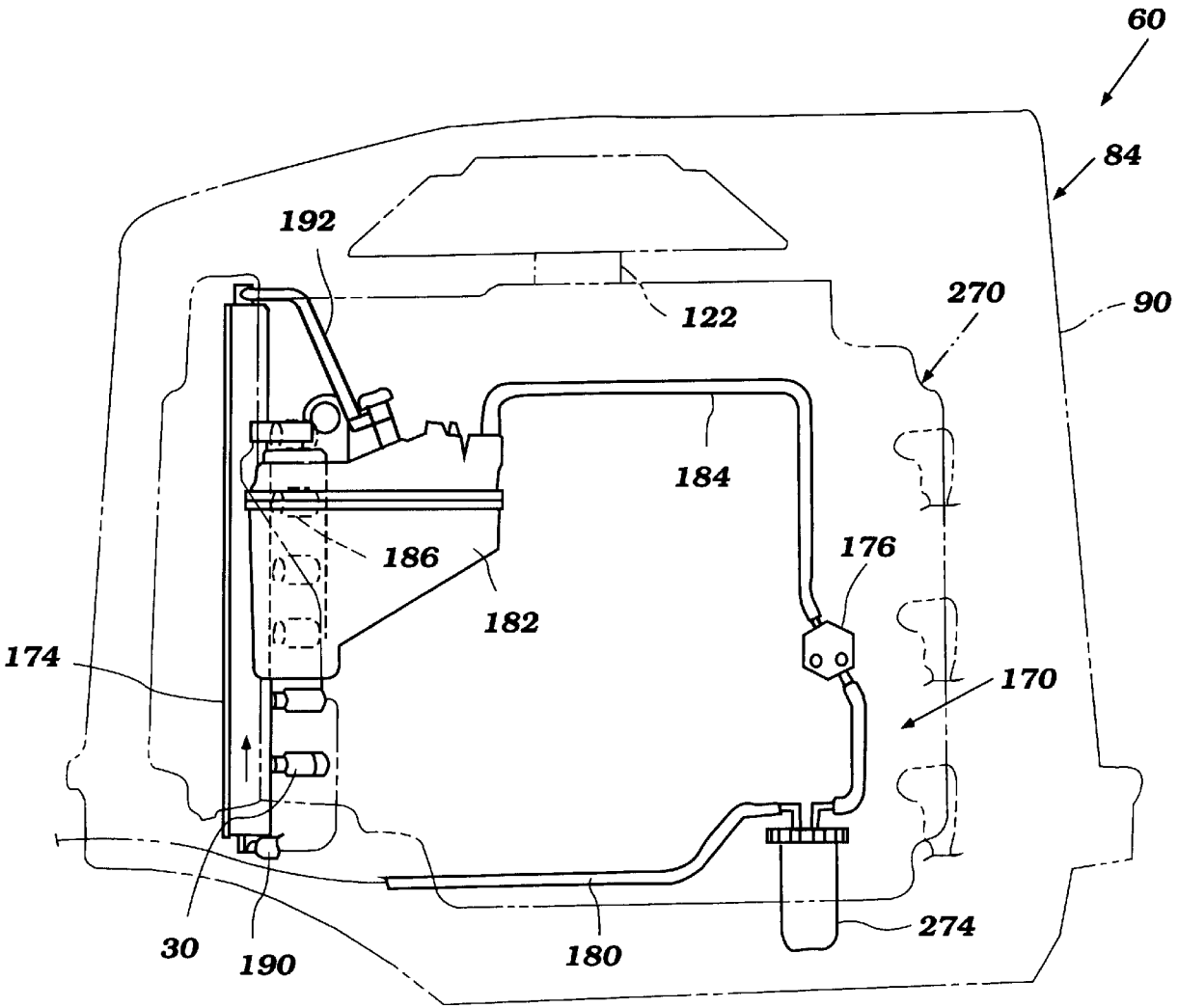
FIG. 9 is a side elevational view of the engine of FIG. 8 as viewed from the position indicated by the arrow 9 in FIG. 8 to show the same engine. The protective cowling is shown in phantom also.

FIGS. 8 and 9 illustrate another engine that can embody the construction and method of the valve actuator mechanism described above. The same members and components that have been described in connection with the outboard motor 60 and engine 62 will be assigned with the same reference numerals in this embodiment with the understanding that the previous description of these components applies equally to this embodiment, unless indicated otherwise.

An engine 270 shown in these figures is of the V6 type and operates on a two stroke crankcase compression principle. Because of this, a single air intake passage 272 couples the plenum chamber member 135 with the crankcase member 118 to supply an air charge from the plenum chamber 128 to the crankcase 120. The air charge is temporarily compressed within the crankcase chamber 120 and delivered to the combustion chambers 110 through scavenge passages that is well known in the art.

The vapor separator 182 of the fuel injection system 170 is mounted on the air intake passage 272. The fuel injectors 30 are supported by the fuel rail 174 and affixed to the air intake passage 272 so that its injection nozzles spray fuel thereinto. The sprayed fuel charge is finally reaches the combustion chambers 110 with an air charge passing through the air intake passage 272 via the scavenge passages. Although schematically shown, the low pressure fuel pump 176 may be actually mounted on the crankcase member 118 and operated by vibrations in pressure in the crankcase 120. A fuel filter 274 is provided upstream of the low pressure fuel pump 176.

The same construction and method of the valve actuator mechanism shown in FIGS. 6 and 7 and the variations thereof that were described above are all applicable to the engine 270.

In this engine 270, lubricant or lubrication oil is previously mingled with the fuel that is sprayed by the fuel injectors 30. If an amount of the lubricant is increased, chances of the adhesion are extremely decreased. Even if the adhesion occurs, only a small voltage is required to release the valves 42 from the valve seats 44.

This is shown in FIG. 5. The curve 266 designates that a small amount of the lubricant is mixed with the fuel. The curve 276 designates that a medium amount of the lubricant is mixed. The curve 278, in turn, designates that a large amount of the lubricant is mixed. There is no difference among them before approximately twelve hours elapse. However, after the time has elapsed, the more lubricant mixed with the fuel, the smaller the voltage required to separate the valves 42 from the valve seats 44.

Figure 10:
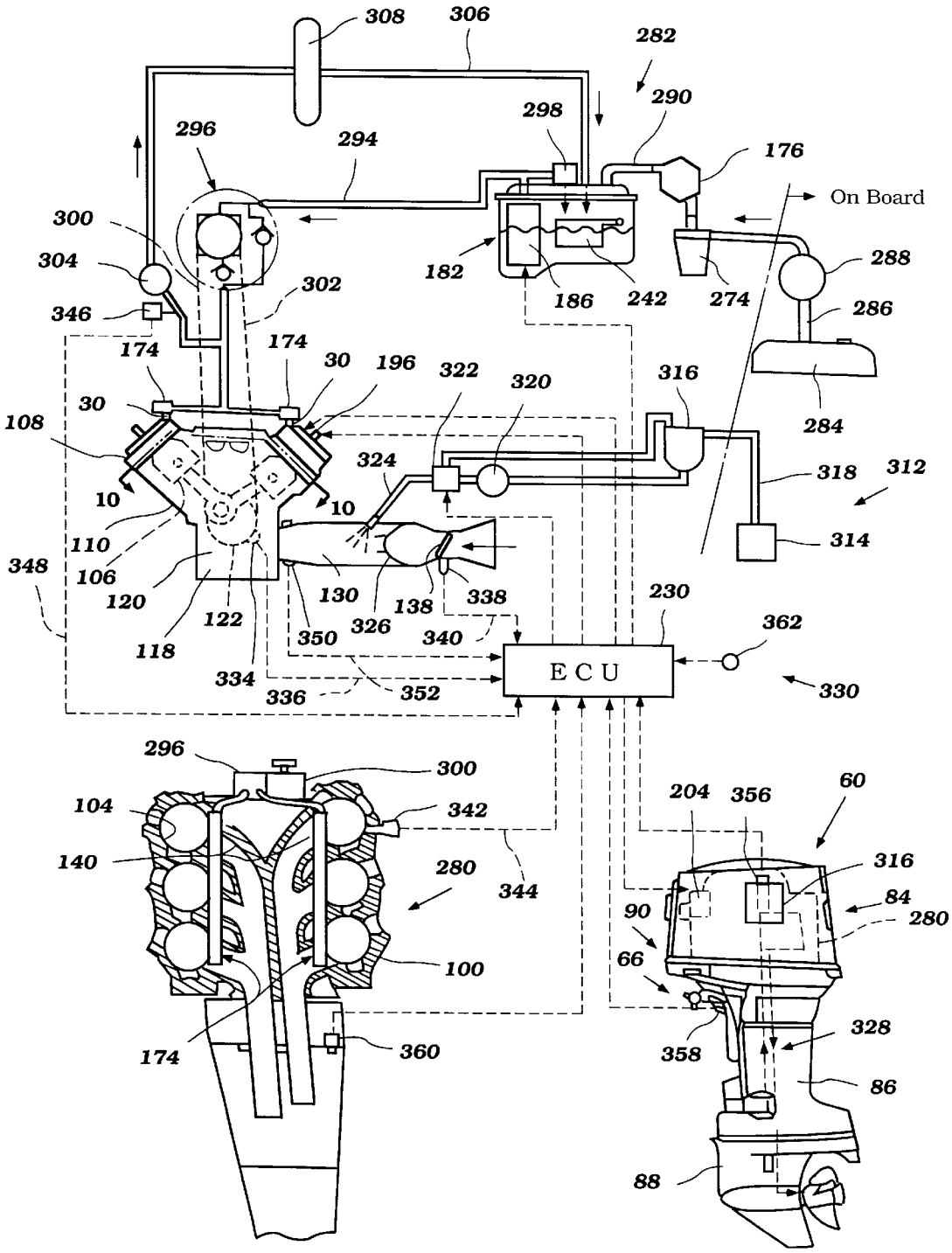
FIG. 10 is a multi-part view showing: in the lower right-hand portion, an outboard motor that can also employ the valve actuator mechanism in the aforenoted embodiment of the present invention; in the upper view, a partially schematic cross-sectional view of the engine of the outboard motor with its air induction and fuel injection system in part schematically; in the lower left-hand portion, a rear elevational view of the outboard motor with portions removed and other portions broken away and shown in section along the line 10—10 in the upper view so as to more clearly show the construction of the engine; and the fuel injection system shown in part schematically. An ECU for the motor links the three views together.

FIG. 10 illustrates another engine 280 that can be applied with the present invention. The same members and components that have been described in connection with the outboard motor 60 and engine 62 will be assigned with the same reference numerals in this embodiment with the understanding that the previous description of these components applies equally to the embodiment, unless indicated otherwise.

The engine 280 is also employed for the outboard motor 60 and is the V6 type operating on a two stroke crankcase compression principle. This engine 280, however, has a fuel injection system 282 that spray fuel directly into the combustion chambers.

The fuel injection system 282 comprises a fuel supply tank 284 that is provided in the hull of the associated watercraft 74. Fuel is drawn from this tank 284 through a conduit 286 by the manually operated fuel pump 288 and the plurality of low pressure fuel pumps 176. The low pressure pumps 176 are, as noted above, diaphragm type pumps operated by variations in pressure in the sections of the crankcase chamber 120, and thus provide a relatively low pressure. The quick disconnect coupling is provided in the conduit 286 and also the fuel filter 274 is positioned in the conduit 286 at an appropriate location.

From the low pressure pumps 176, fuel is supplied to the vapor separator 182 which is mounted on the engine 280 or within the protective cowling assembly 90 at an appropriate location. The fuel is supplied through a line 290. At the vapor separator 182 and end of the line 290, there is provided at a float valve that is operated by a float 292 so as to maintain a uniform level of fuel in the vapor separator 182.

The high pressure electric fuel pump 186 is provided in the vapor separator 182 and pressurizes fuel that is delivered through a fuel supply line 294 to a super high pressure fuel pump unit 296. The electric fuel pump 186, which is driven by an electric motor, develops a pressure such as 3 to 10 $kg/cm^2$. A low pressure regulator 298 is positioned in the line 294 at the vapor separator 182 and limits the pressure that is delivered to the super high pressure pump unit 296 by dumping the fuel back to the vapor separator 182. The super high pressure pump unit 296 can develop a pressure of, for example, 50 to 100 $kg/cm^2$ or more. A pump drive unit 300 is provided for driving the super high pressure pump unit 296. The pump drive unit 300 itself is driven by the crankshaft 122 with drive mechanism that includes a drive belt 302.

The pressure of the fuel supplied by the super high pressure pump unit 296 is regulated to a fixed value by a high pressure regulator 304 that dumps fuel back to the vapor separator 182 through a pressure relief line 306 in which a fuel heat exchanger or cooler 308 is provided.

The engine 280 includes an oil or lubricant supply system 312 for lubricating engine components. The lubricant supply system 312 comprises a lubricant tank 314 disposed in the hull of the associated watercraft 74 as well as the fuel tank 284. Lubricant is supplied to a lubricant reservoir 316 mounted on the engine 280 through a supply line 318. The lubricant in the reservoir 316 is pumped up by the oil pump 320 and delivered to solenoid valves 322. The solenoid valves 322 are intermittently opened under control of the ECU 230 and therefore the lubricant is injected into the air intake passages 130 positioned downstream of reed valves 326 by lubricant injectors 324 in response to the requirement of the engine 280.

An engine cooling system 328 is also provided in the outboard motor 60.

A feedback control system 330 controls the engine operations including the initiation and duration of the fuel injection, the timing of the firing and lubricant injection. The feedback control system 330 comprises the ECU 230 and a number of sensors which sense either engine running conditions, ambient conditions or conditions of the outboard motor 60 that will effect engine performance.

Certain sensors are shown schematically in FIG. 10. For example, there is provided a crankshaft angle position sensor 334 that, when measuring crankshaft angle versus time, outputs a crankshaft rotational speed signal or engine speed signal indicated schematically at 336 to the ECU 230.

Operator demand or engine load, as determined by throttle angle of the throttle valve 138, is sensed by a throttle position sensor 338 which outputs a throttle position or load signal 340 to the ECU 230. When the operator desires to gather speed, i.e., accelerate the engine operation, a throttle, for example, disposed on a steering handle (not shown) is operated by the operator. The throttle valve 138 is, then opened toward a certain open position that corresponds to the desired speed. Correspondingly, more air is induced into the crankcase chamber 120 through the air intake passages 130. The engine load also increases when the associated watercraft advances against wind. In this situation, the operator also operates the throttle so as to recover the speed that may be lost.

A combustion condition or oxygen ($O_2$) sensor 342 senses the in cylinder combustion conditions by sensing the residual amount of oxygen in the combustion products at a time near the time when the exhaust port is opened. This output and air fuel ratio signal is indicted schematically at 344 to the ECU 230.

There is also provided a pressure sensor 346 that is connected to the high pressure regulator 304. This pressure sensor 346 outputs the high pressure signal 348 to the ECU 230.

An intake air temperature sensor 350 is provided and this sensor 350 outputs an intake air temperature signal 352 to the ECU 230.

Except for the sensors described above, there are an oil level sensor 356, trim angle sensor 358, back pressure sensor 360, power source initiation sensor (main switch) 362 and water temperature sensor (not shown) provided in this control system 312 and these sensors are connected to the ECU 230 by respective lines.

The ECU 230, as has been noted, outputs signals to the fuel injectors 30, spark plugs 196, solenoid valves 322, high pressure electric fuel pump 182 and starter motor 204 for their respective control through respective control lines.

The same construction and method of the valve actuator mechanism shown in FIGS. 6 and 7 and the variations thereof described above also are all applicable to this engine 280.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned or replace by known equivalents as desired. Moreover, not all of the features, aspects and advantages are necessarily required to practice the present invention. Accordingly, the scope of the present invention is intended to be defined only by the claims that follow.

What is claimed is:

1. A fuel injection system for an internal combustion engine having a cylinder body defining a cylinder bore in which a piston reciprocates, a cylinder head affixed to an end of the cylinder body and defining a combustion chamber with the cylinder head and the piston, the fuel injection system comprising at least one fuel injector spraying fuel through at least one opening to supply fuel to the combustion chamber, the fuel injector including a valve movable between an open position and a closed position to regulate fuel flow through the opening, an actuator to move the valve from the closed position, a first power supply to supply power to the actuator under a normal operating condition of the engine, a second power supply to supply power greater than the power supplied by the first power supply to the actuator, and a switchover device to selectively change the power supply to the actuator between the first power supply and the second power supply.

2. A fuel injection system as set forth in claim 1, wherein the first and second power supplies are electrical power supplies.

3. A fuel injection system as set forth in claim 2, wherein the second power supply includes a voltage booster to raise the voltage of the applied electric power to the actuator.

4. A fuel injection system as set forth in claim 3, wherein the second power supply includes a power source coupled to the voltage booster.

5. A fuel injection system as set forth in claim 4, wherein the power source includes a battery.

6. A fuel injection system as set forth in claim 4, wherein the second power supply additionally includes a switching device to decouple the power source from the voltage booster.

7. A fuel injection system as set forth in claim 6, wherein the switching device includes a manually operable switch.

8. A fuel injection system as set forth in claim 6, wherein the switching device includes a timed switch that operates with a preset time delay.

9. A fuel injection system as set forth in claim 1, wherein the switchover device includes detachable connectors.

10. A fuel injection system as set forth in claim 9, wherein the actuator, the first power supply and the second power supply each have one of the connectors, and the connector of the actuator is selectively connectable with one of the connectors of the first and second power supplies.

11. A fuel injection system as set forth in claim 1, wherein the switchover device includes a manually operable switch.

12. A fuel injection system as set forth in claim 1 further comprising a controller electrically controlling the actuator, and the switchover device being controlled by the controller.

13. A fuel injection system as set forth in claim 1, wherein the actuator includes an electromagnetic driver.

14. A fuel injection system as set forth in claim 1, wherein the first power supply includes a battery.

15. A fuel injection system as set forth in claim 1, wherein the first power supply includes a controller, and the actuator is controlled by the controller.

16. A fuel injection system as set forth in claim 1, wherein the first power supply includes a generator driven by the engine.

17. A fuel injection system as set forth in claim 1, wherein the engine is employed for an outboard motor.

18. A fuel injection system as set forth in claim 1, wherein the cylinder bore extends generally horizontally, and the fuel injector also lies generally horizontally.

19. A fuel injection system for an internal combustion engine having a cylinder body defining a cylinder bore in which a piston reciprocates, a cylinder head affixed to an end of the cylinder body and defining a combustion chamber with the cylinder head and the piston, the fuel injection system comprising at least one fuel injector to spray fuel to the combustion chamber, the fuel injector including a valve and a valve seat on which the valve sits, the fuel being sprayed only when the valve is unseated, a biasing mechanism to bias the valve toward the valve seat so that the valve sits on the valve seat, an actuator mechanism to actuate the valve to unseat with an actuating force that acts against the biasing force of the biasing mechanism, the actuator mechanism being adapted also to apply a separating force that is greater than the actuating force to the valve to separate the valve from the valve seat when the valve adheres to the valve seat, the actuator mechanism including an electromagnetic actuator, a first power supply and a second power supply, the second power supply supplying greater electric power to the actuator, when the actuator mechanism produces the separating force, than the power supplied by the first power supply when actuating the valve with the actuating force.

20. A method for controlling a fuel injection system having a fuel injector spraying fuel through at least one opening to supply the fuel to a combustion chamber of an internal combustion engine, a controller for controlling the fuel injector, the fuel injector including a valve that selectively opens and closes the opening under control of the controller, and first and second power supplies that supply electric power to the fuel injector to actuate the valve, the second power supply supplying greater power than the first power supply, the method comprising actuating the valve to open the opening by the first power supply, and changing the first power supply to the second power supply to actuate the valve by the second power supply when the valve remains in the closed position against the control of the controller.

21. A method as set forth in claim 20 additionally comprising ceasing the separating operation after a preset time.

22. An internal combustion engine for a marine propulsion unit comprising an engine body, a movable member movable relative to the engine body, the engine body and the movable member together defining a combustion chamber, a fuel injector arranged to spray fuel for combustion in the combustion chamber, and a power supply including a voltage booster, the fuel injector including an injector body defining an opening through which the fuel is sprayed, the injector body extending generally horizontally, a valve selectively movable between an open position and a closed position of the opening, and an electrically operable actuator ranged to move the valve from the closed position to the open position with a preset actuating force, the power supply arranged to supply electric power to the actuator for generating the preset actuating force, the power supply being capable to supply greater power to the actuator for generating a compulsory opening force that is greater than the actuating force when the valve does not move from the closed position, and the voltage booster producing the greater power that generates the compulsory opening force.

23. An internal combustion engine as set forth in claim 22, wherein the marine propulsion unit is adapted to be mounted on an associated watercraft for tilt movement, and the injection body is laid so that the opening is positioned higher than another portion of the injection body when the marine propulsion unit is tilted.

24. An internal combustion engine as set forth in claim 22, wherein the power supply additionally includes a manual switch to activate the voltage booster.

25. An internal combustion engine as set forth in claim 22, wherein the power supply includes a timer to regulate a period of time for generating the compulsory opening force, and a manual switch to start the timer.

26. An internal combustion engine as set forth in claim 25, wherein the power supply ceases generating the compulsory opening force by either time up of the timer or turn off of the manual switch.

27. A booster unit adapted to activate a fuel injector mounted on an internal combustion engine independently of a control device disposed at a location of the engine when the fuel injector is out of control of the control device, comprising a voltage booster to raise voltage of electric power to the fuel injector, a timer to regulate a period of time for which the voltage regulator operates, and a manual switch to start the timer, the voltage booster ceasing the operation thereof by either time up of the timer or turn off of the manual switch.

* * * * *